US007882715B2

(12) United States Patent
Yoo et al.

(10) Patent No.: US 7,882,715 B2
(45) **Date of Patent: *Feb. 8, 2011**

(54) METHOD FOR CLEANING FOREIGN MATERIALS FILTERING APPARATUS

(75) Inventors: Sang-Hee Yoo, Gyeongsangnam-Do (KR); Jong-Deuk Bae, Gyeongsangnam-Do (KR); Bo-Young Chang, Gyeongsangnam-Do (KR); Young-Bae Park, Gyeongsangnam-Do (KR); Ji-Maeng Kim, Gyeongsangnam-Do (KR); Soo-Jin Jung, Gyeongsangnam-Do (KR); Ae-Na Jo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 123 days.

This patent is subject to a terminal disclaimer.

(21) Appl. No.: 12/041,914

(22) Filed: Mar. 4, 2008

(65) Prior Publication Data

US 2008/0217243 A1 Sep. 11, 2008

(30) Foreign Application Priority Data

Mar. 6, 2007 (KR) ..... 10-2007-0022175

(51) Int. Cl.
*D06F 39/10* (2006.01)

(52) U.S. Cl. ..... 68/12.13; 210/167.01; 210/171; 210/251

(58) Field of Classification Search ..... None
See application file for complete search history.

(56) References Cited

U.S. PATENT DOCUMENTS

| | | | | | |
|---|---|---|---|---|---|
| 2,413,954 | A | * | 1/1947 | Conterman | 210/451 |
| 2,586,508 | A | | 2/1952 | Brotman | |
| 2,936,604 | A | | 5/1960 | Glendening | |
| 2,939,305 | A | * | 6/1960 | Neidhart et al. | 68/18 F |
| 2,971,362 | A | * | 2/1961 | Olding | 68/18 F |
| 3,027,742 | A | * | 4/1962 | Nowicki | 68/18 FA |
| 3,040,552 | A | * | 6/1962 | Platt et al. | 68/18 F |
| 3,240,345 | A | | 3/1966 | Butler et al. | |
| 3,727,435 | A | * | 4/1973 | Menk | 68/18 F |
| 3,769,818 | A | * | 11/1973 | Smith | 68/18 F |
| 3,805,404 | A | * | 4/1974 | Gould | 34/75 |
| 3,836,001 | A | * | 9/1974 | Heldreth | 210/167.01 |
| 3,891,548 | A | * | 6/1975 | Marcussen | 210/791 |
| 3,896,641 | A | * | 7/1975 | Worst | 68/17 R |
| 3,910,076 | A | * | 10/1975 | Ruble | 68/18 F |

(Continued)

FOREIGN PATENT DOCUMENTS

DE 30-10-182 A1 10/1981

(Continued)

*Primary Examiner*—Robert James Popovics
(74) *Attorney, Agent, or Firm*—Birch, Stewart, Kolasch & Birch, LLP

(57) ABSTRACT

In a method for cleaning the foreign materials filtering, foreign materials collected in a foreign materials filtering space can be easily removed under a filter unit is separated from or is mounted at a filter cover unit. As a result, can be solved the conventional problems that a net filter has to be kept inside out at the time of a cleaning process to cause a user's hands to become dirty, and there is a difficulty in removing foreign materials from the net filter due to a fibrous characteristic of the net filter. Accordingly, a cleaning operation for the foreign materials filtering apparatus can be facilitated.

8 Claims, 9 Drawing Sheets

U.S. PATENT DOCUMENTS

| | | | | | |
|---|---|---|---|---|---|
| 3,977,219 | A | * | 8/1976 | Bochan | 68/18 F |
| 4,081,975 | A | * | 4/1978 | Wortham et al. | 68/18 FA |
| 4,417,457 | A | * | 11/1983 | Brenner | 68/17 A |
| 4,566,970 | A | * | 1/1986 | Piai et al. | 210/409 |
| 4,622,142 | A | | 11/1986 | Teranishi | |
| 4,833,900 | A | * | 5/1989 | Babuin et al. | 68/18 F |
| 5,018,372 | A | * | 5/1991 | Altnau, Sr. | 68/18 F |
| 5,078,862 | A | * | 1/1992 | Justice | 210/94 |
| 5,353,612 | A | * | 10/1994 | Noguchi et al. | 68/12.02 |
| 5,437,789 | A | * | 8/1995 | Sabo et al. | 210/357 |
| 5,509,283 | A | * | 4/1996 | Lee et al. | 68/18 F |
| 5,618,419 | A | | 4/1997 | Fuerst | |
| 5,829,275 | A | * | 11/1998 | Babuin et al. | 68/12.13 |
| 5,849,182 | A | * | 12/1998 | Shin | 210/167.01 |
| 5,858,220 | A | * | 1/1999 | Shin | 210/167.01 |
| 5,863,423 | A | * | 1/1999 | Shin et al. | 210/167.01 |
| 5,931,027 | A | * | 8/1999 | Shin | 68/18 F |
| 5,989,418 | A | * | 11/1999 | Shin | 210/167.01 |
| 6,076,378 | A | * | 6/2000 | Shin | 68/18 F |
| 6,841,058 | B2 | * | 1/2005 | Culvey et al. | 205/690 |
| 7,267,289 | B2 | * | 9/2007 | Lyons | 239/461 |
| 7,412,853 | B2 | * | 8/2008 | Hong et al. | 68/19.1 |
| 2001/0010165 | A1 | * | 8/2001 | Kubota et al. | 68/12.12 |
| 2004/0159130 | A1 | * | 8/2004 | Lee | 68/208 |
| 2005/0000920 | A1 | * | 1/2005 | Smolley | 210/791 |
| 2005/0132759 | A1 | * | 6/2005 | Guinibert et al. | 68/24 |
| 2005/0246843 | A1 | * | 11/2005 | Song et al. | 8/158 |
| 2006/0075790 | A1 | * | 4/2006 | Jeon et al. | 68/17 R |
| 2006/0096335 | A1 | * | 5/2006 | Park et al. | 68/20 |
| 2006/0123854 | A1 | * | 6/2006 | Hong et al. | 68/19.1 |
| 2006/0185403 | A1 | * | 8/2006 | Ikemizu et al. | 68/12.18 |
| 2008/0141554 | A1 | * | 6/2008 | Bae et al. | 34/132 |
| 2008/0141734 | A1 | * | 6/2008 | Son et al. | 68/5 C |
| 2008/0216518 | A1 | * | 9/2008 | Yoo et al. | 68/12.13 |
| 2008/0216519 | A1 | * | 9/2008 | Yoo et al. | 68/12.13 |
| 2008/0216520 | A1 | * | 9/2008 | Yoo et al. | 68/12.13 |
| 2008/0216522 | A1 | * | 9/2008 | Yoo et al. | 68/18 F |
| 2008/0216523 | A1 | * | 9/2008 | Yoo et al. | 68/212 |
| 2008/0217243 | A1 | * | 9/2008 | Yoo et al. | 210/636 |
| 2008/0276659 | A1 | * | 11/2008 | Bae et al. | 68/5 C |
| 2008/0276661 | A1 | * | 11/2008 | Bae et al. | 68/5 C |
| 2008/0302138 | A1 | * | 12/2008 | Bae et al. | 68/12.05 |
| 2008/0313922 | A1 | * | 12/2008 | Bae et al. | 34/491 |
| 2009/0078007 | A1 | * | 3/2009 | Bae et al. | 68/5 C |
| 2009/0100882 | A1 | * | 4/2009 | Bae et al. | 68/5 C |
| 2009/0113745 | A1 | * | 5/2009 | Choi et al. | 34/139 |
| 2009/0120140 | A1 | * | 5/2009 | Choi et al. | 68/5 C |

FOREIGN PATENT DOCUMENTS

| | | | |
|---|---|---|---|
| JP | 02-005998 | A | 1/1990 |
| JP | 02-114993 | A | 4/1990 |
| JP | 06-319895 | A | 11/1994 |
| JP | 08-323096 | A | 12/1996 |
| JP | 09-299685 | A | 11/1997 |
| JP | 10-000293 | A | 1/1998 |
| JP | 11-208901 | A | 8/1999 |
| JP | 2000-354697 | A | 12/2000 |
| KR | 10-2001-0073573 | A | 8/2001 |
| KR | 10-2002-0045381 | A | 6/2002 |
| WO | WO-2005/118940 | A1 | 12/2005 |

* cited by examiner

METHOD FOR CLEANING FOREIGN MATERIALS FILTERING APPARATUS

RELATED APPLICATION

The present invention relates to subject matter contained in priority Korean Application No. 10-2007-0022175, filed on Mar. 6, 2007, which is herein expressly incorporated by reference in its entirety.

BACKGROUND OF THE INVENTION

1. Field of the Invention

The present invention relates to a washing machine, and more particularly, to a method for cleaning a foreign materials filtering apparatus which filters foreign materials such as nap floating in a washing tub.

2. Description of the Background Art

Generally, a washing machine serves to remove each kind of foreign materials attached to laundry such as clothes and bedclothes by a softening operation using detergents, by a frictional operation using a washing current according to rotation of a pulsator, and by an impact applied to laundry from the pulsator, etc.

The washing machine comprises a cabinet that forms the appearance; a reservoir received in the cabinet; a washing tub received in the reservoir, and rotated at the time of a washing or dehydrating process; a motor installed at a bottom surface of the reservoir, for rotating a pulsator and the washing tub; and a clutch for determining a transmission direction of a driving force from the motor, such that both the pulsator and the washing tub rotate at the time of a washing operation, and only the washing tub rotates at the time of a dehydrating operation. The washing machine further comprises a net filter installed at an inner side of the washing tub, for filtering foreign materials such as nap separated from laundry during a washing operation.

The operation of the net filter has been described in Korean Laid-Open Publication No. 2001-73573 or 2002-45381. More concretely, as a pulsator rotates, washing water collected at a lower end of the pulsator rises to an upper side of a washing tub along a flow passage formed between an inner wall and an outer wall of the washing tub. Then, the risen washing water is re-introduced into the washing tub via a mesh of a net filter. Here, foreign materials of the washing water does not pass through the mesh thus to be filtered.

However, the conventional net filter has the following problems.

First of all, the net filter has to be kept inside out at the time of a cleaning process, which may cause a user's hands to become dirty.

Also, there is a difficulty in removing foreign materials from the net filter due to a fibrous characteristic of the net filter.

SUMMARY OF THE INVENTION

Therefore, it is an object of the present invention to provide a method for cleaning a foreign materials filtering apparatus capable of facilitating a cleaning operation.

To achieve these and other advantages and in accordance with the purpose of the present invention, as embodied and broadly described herein, there is provided a method for cleaning a foreign materials filtering apparatus, comprising: separating a foreign materials filtering apparatus from a washing water circulating duct; opening a foreign materials filtering space of the foreign materials filtering apparatus; and removing foreign materials collected in the foreign materials filtering apparatus.

The step of separating the foreign materials filtering apparatus from the washing water circulating duct comprises: separating the foreign materials filtering apparatus from hook coupling holes of the washing water circulating duct by pressing hooks of the foreign materials filtering apparatus; and detaching the foreign materials filtering apparatus from a filter insertion hole of the washing water circulating duct. Preferably, the step of detaching the foreign materials filtering apparatus from a filter insertion hole of the washing water circulating duct is performed under a state that the hooks are pressed.

In the step of detaching the foreign materials filtering apparatus from a filter insertion hole of the washing water circulating duct, preferably, a guide protrusion formed at the periphery of the filter insertion hole guides a filter cover of the foreign materials filtering apparatus.

The step of opening a foreign materials filtering space of the foreign materials filtering apparatus comprises: pulling a rear filter of a filter unit toward a rear side of a front filter of the filter unit, in a state that the filter unit of the foreign materials filtering apparatus is mounted at a filter cover unit; rotating the rear filter centering around one side of the front filter, or separating coupling protrusions of the rear filter from coupling holes of the front filter; and rotating hinges of the rear filter in hinge holes of the front filter.

According to another aspect, the step of opening a foreign materials filtering space of the foreign materials filtering apparatus comprises: separating front and rear filters of a filter unit from a handle of a filter cover unit in a pulling manner, in a state that the filter unit is separated from the filter cover unit; pulling a rear filter of the filter unit toward a rear side of the front filter of the filter unit; and rotating the rear filter centering around one side of the front filter, or separating coupling protrusions of the front filter of the filter unit from coupling holes of the handle of the filter cover unit; separating coupling protrusions of the rear filter from coupling holes of the front filter; and rotating hinges of the rear filter in hinge holes of the front filter.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
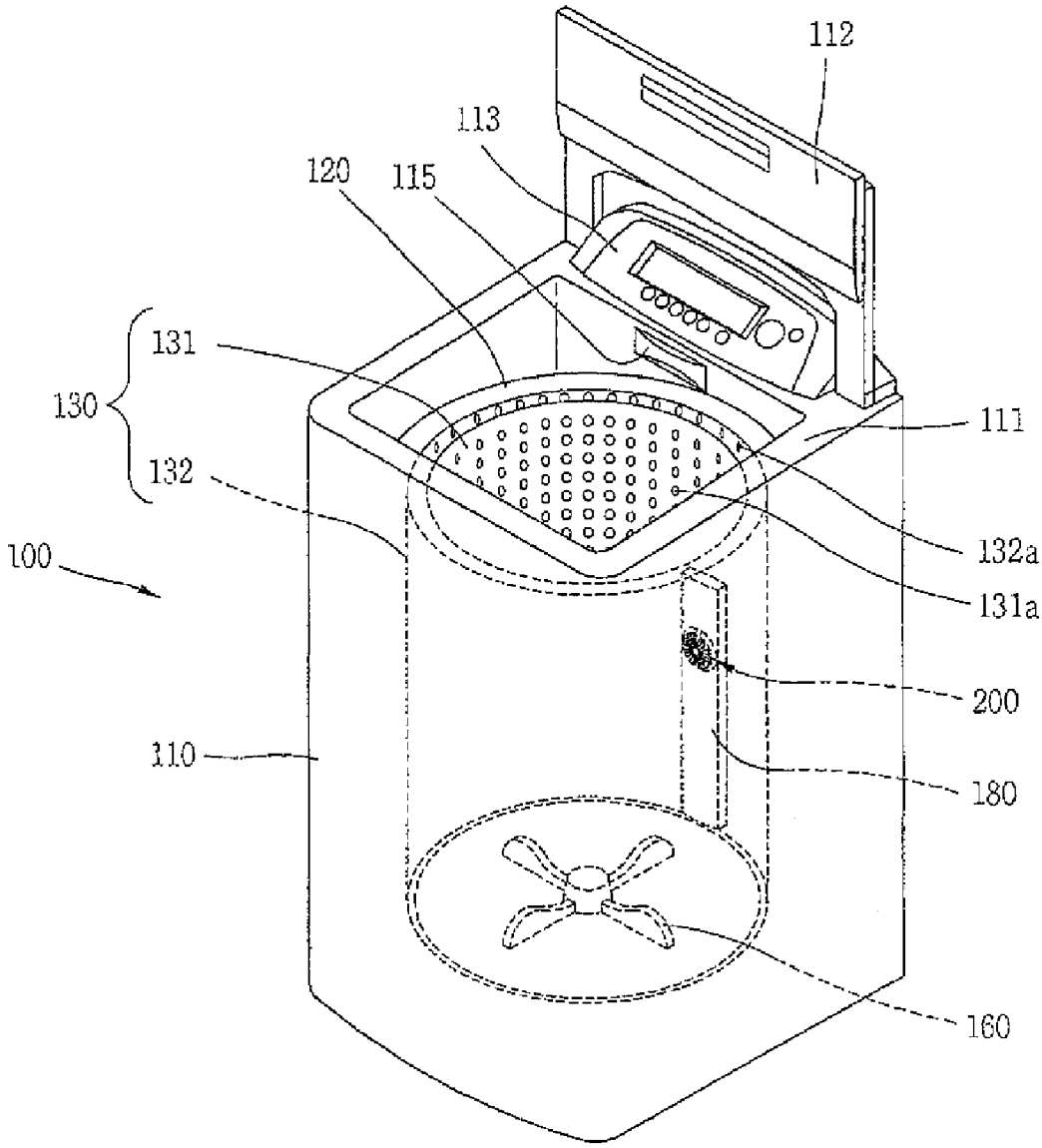
FIG. 1 is a perspective views of a washing machine having a foreign materials filtering apparatus according to a first embodiment of the present invention.
Figure 2:
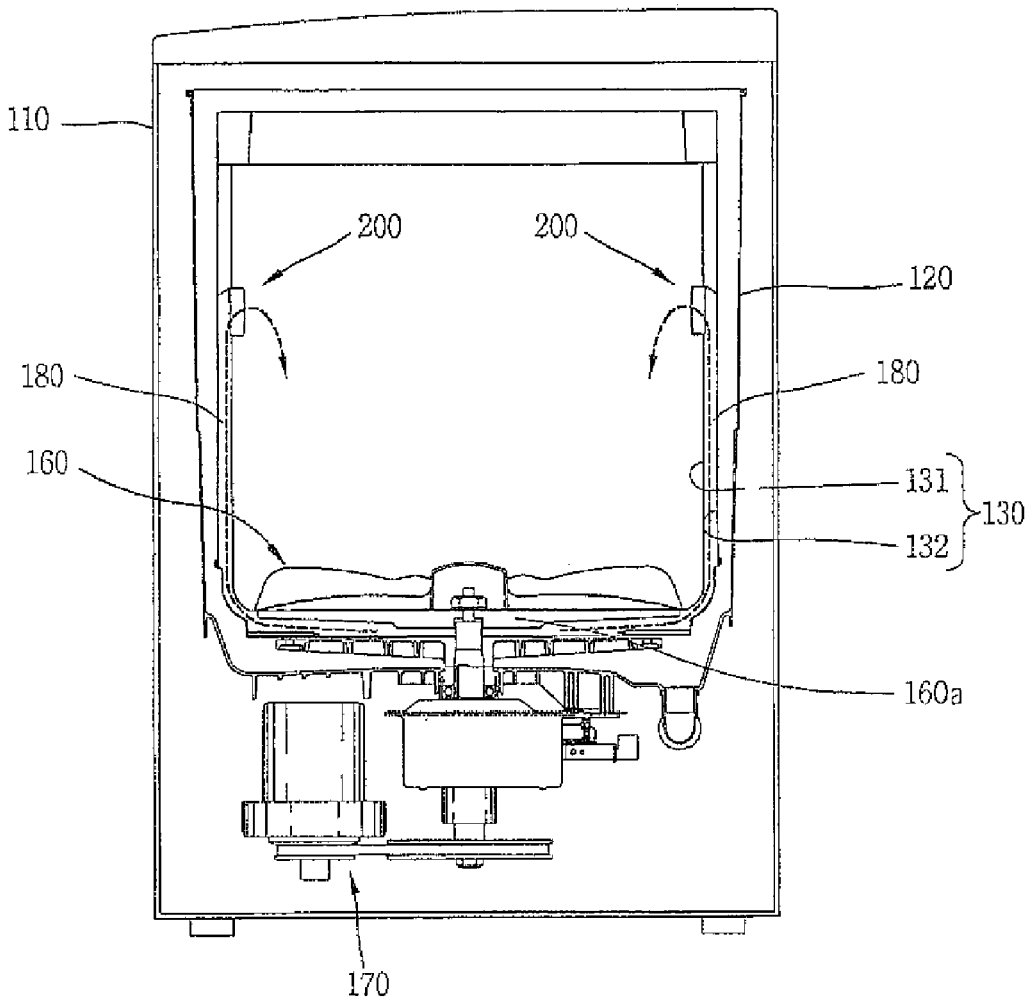
FIG. 2 is a side sectional view of the washing machine of FIG. 1.
Figure 3:
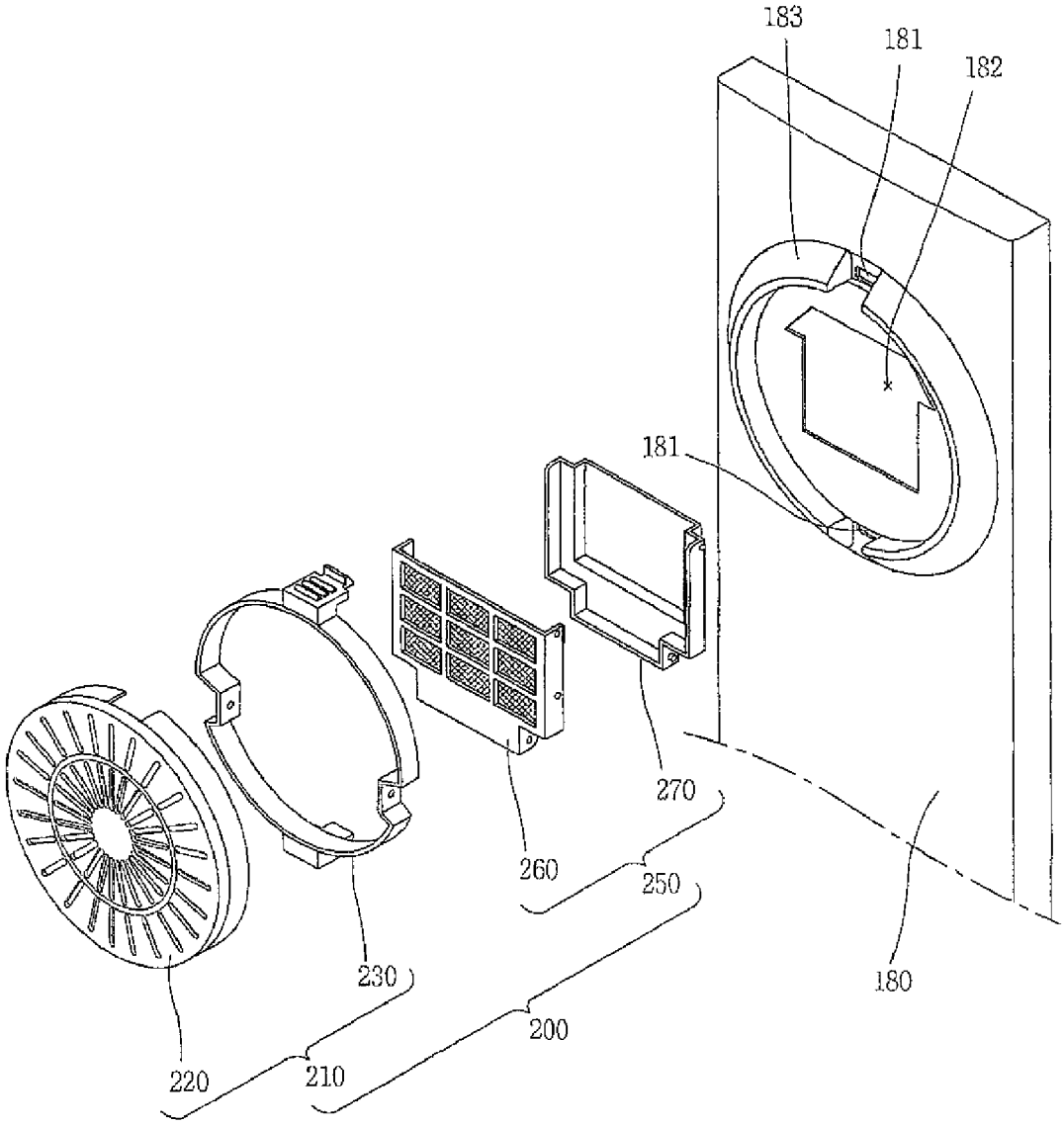
FIG. 3 is an exploded perspective view of the foreign materials filtering apparatus of FIG. 1.
Figure 4:
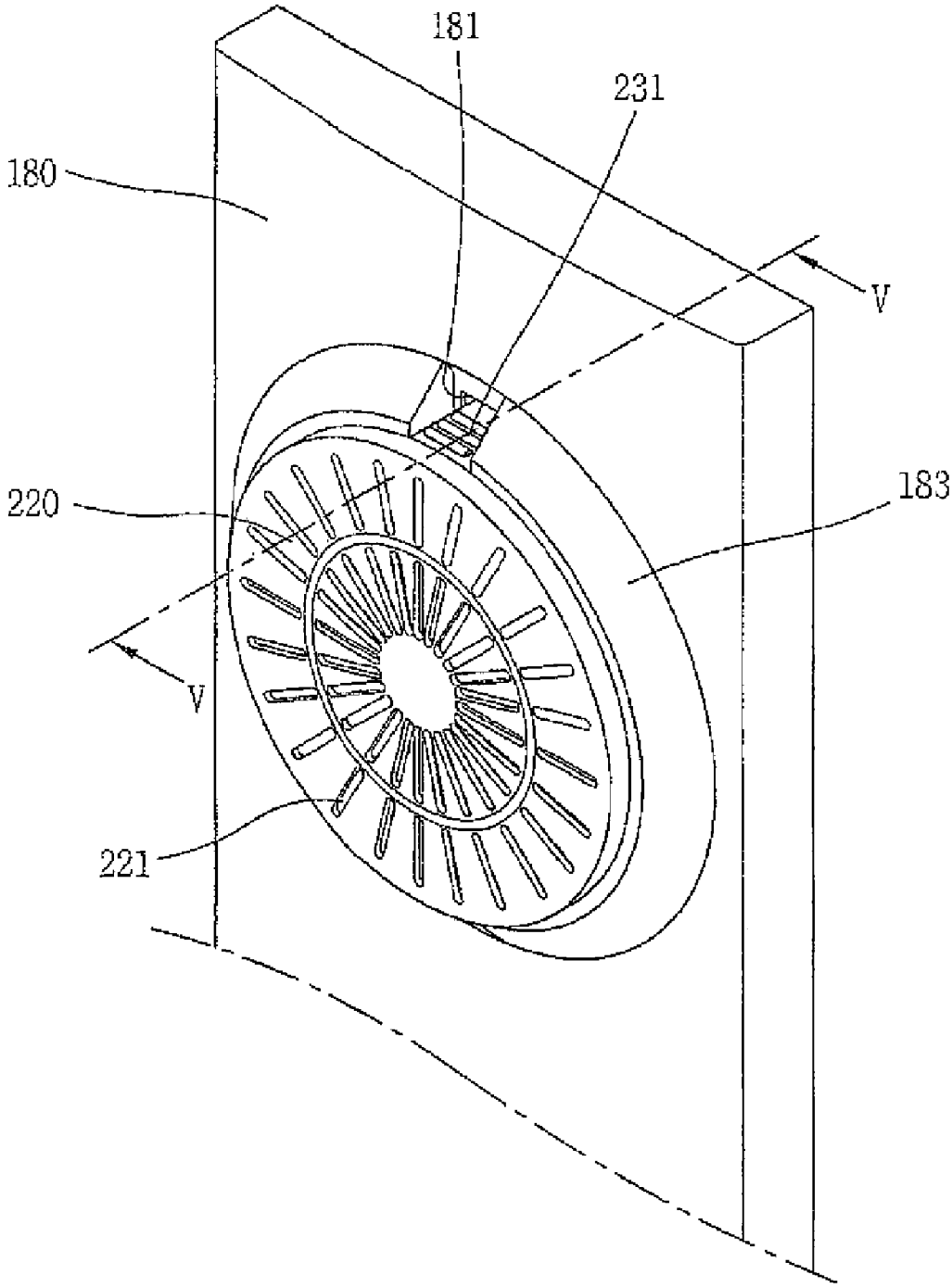
FIG. 4 is a perspective view showing a state that a foreign materials filtering apparatus is detachably mounted at a washing water circulating duct of FIG. 1.
Figure 5:
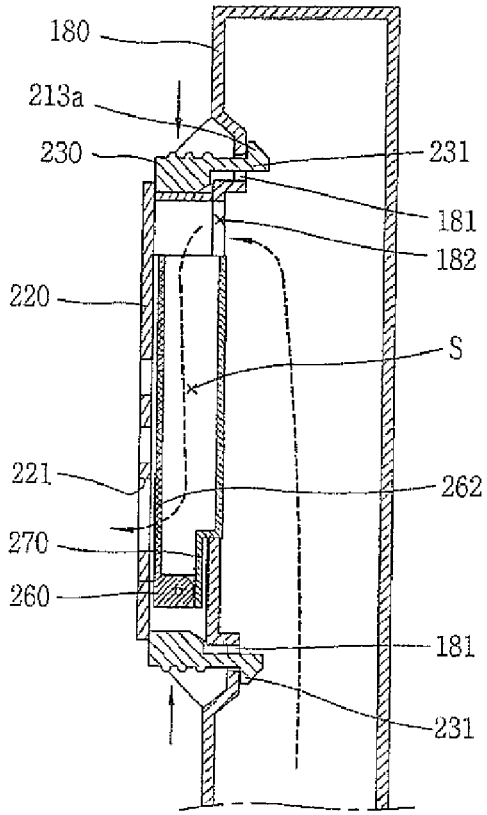
FIG. 5 is a sectional view taken along line 'V-V' of FIG. 4.
Figure 6:
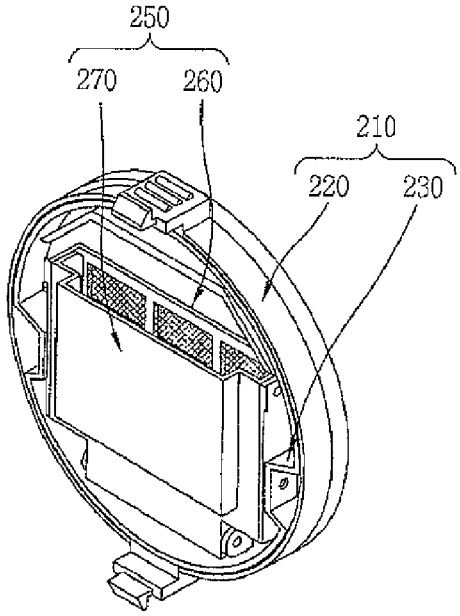
FIG. 6 is an exploded rear view of the foreign materials filtering apparatus of FIG. 4.
Figure 7:
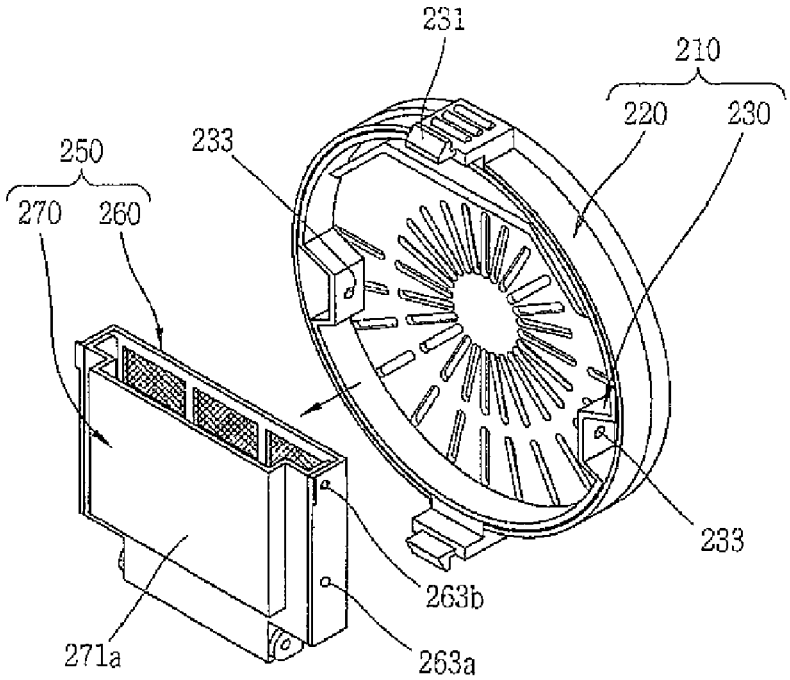
FIG. 7 is a view showing a state that a filter cover unit and a filter unit of FIG. 6 are separated from each other.
Figure 8:
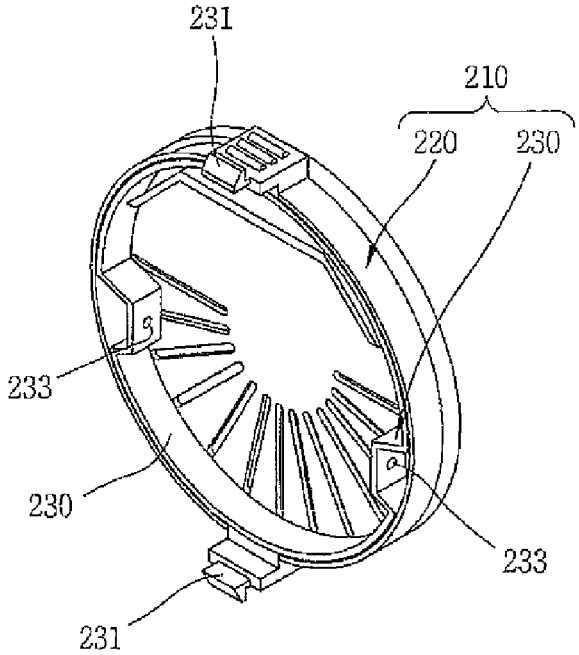
FIG. 8 is a view showing the filter cover unit of FIG. 7.
Figure 9:
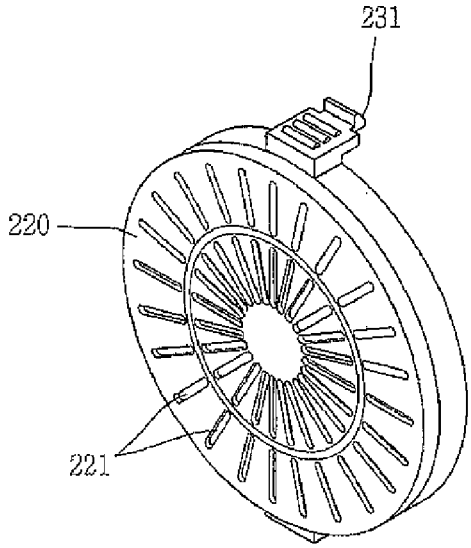
FIG. 9 is a perspective view of a cap of FIG. 8.
Figure 10:
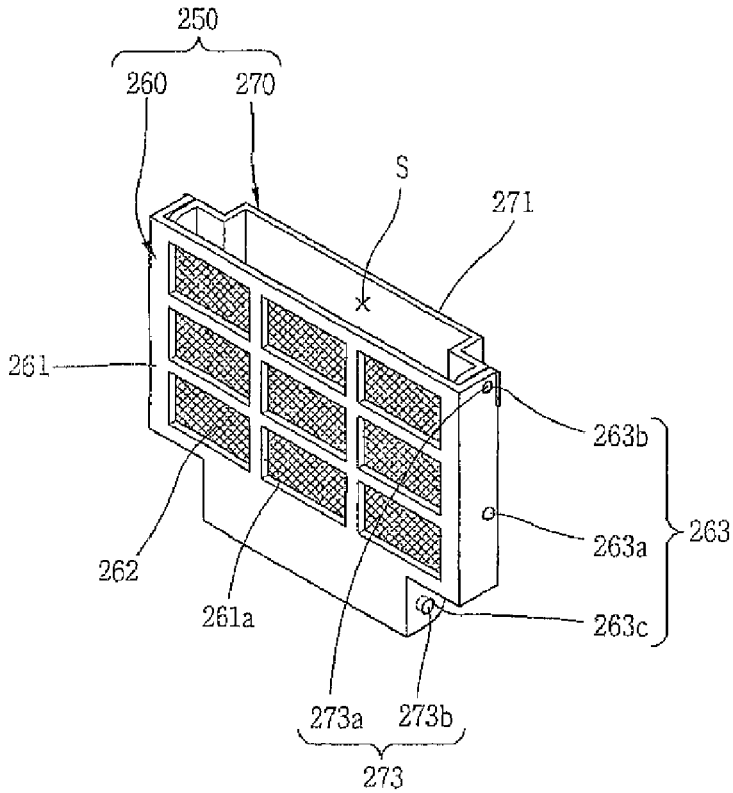
FIG. 10 is a view showing the filter unit of FIG. 7.
Figure 11:
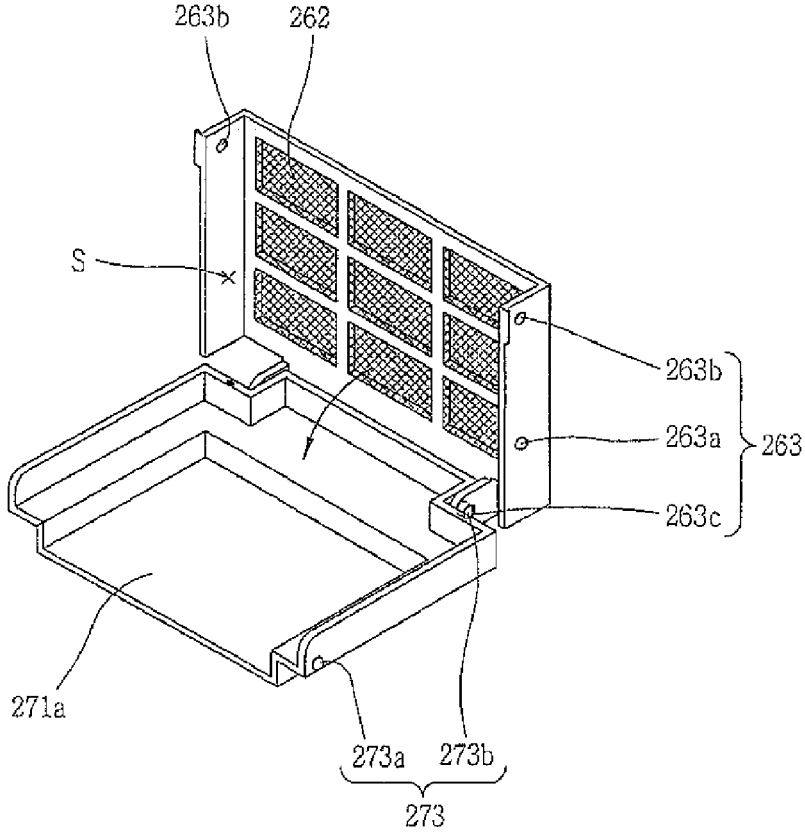
FIG. 11 is a view showing a state that a rear filter of FIG. 10 is backward opened.
Figure 12:
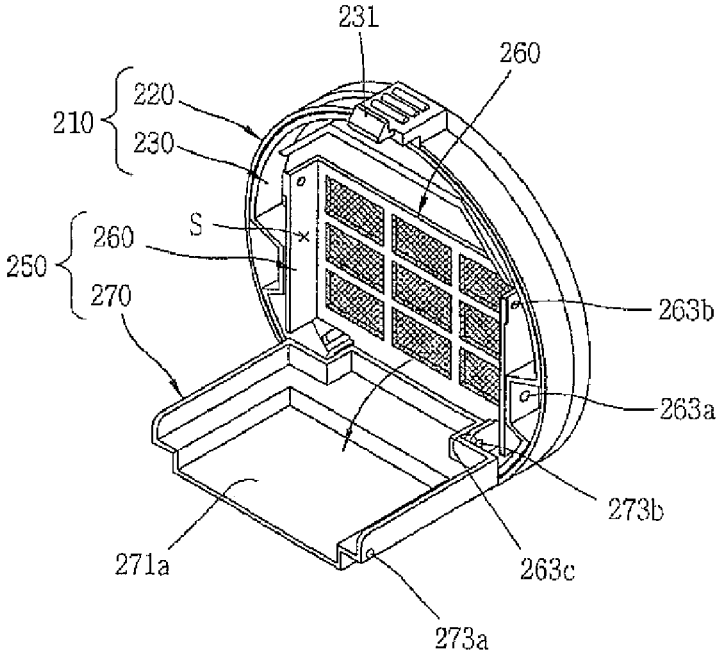
FIG. 12 is a view showing a state that a rear filter of a filter unit of FIG. 6 is backward opened.
Figure 13:
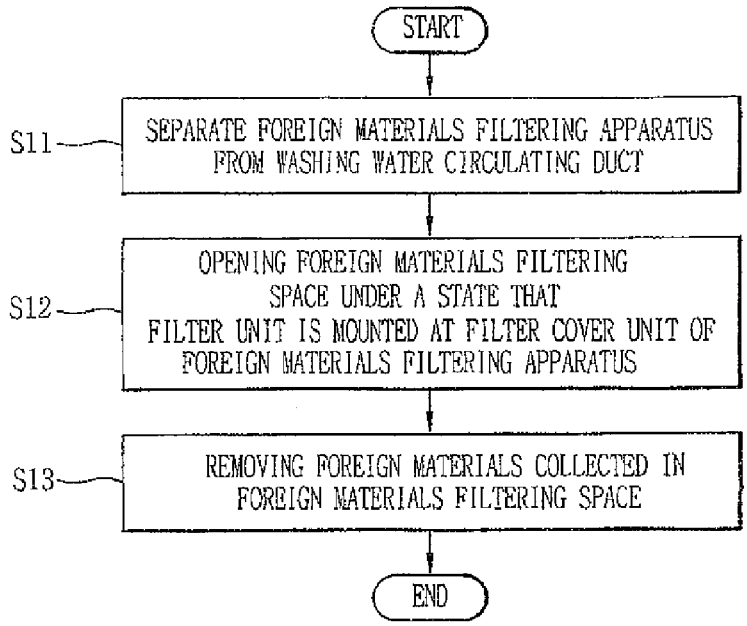
FIG. 13 is a flowchart showing a method for cleaning the foreign materials filtering apparatus of FIG. 1 under a state that a filter unit is mounted at a filter cover unit.
Figure 14:
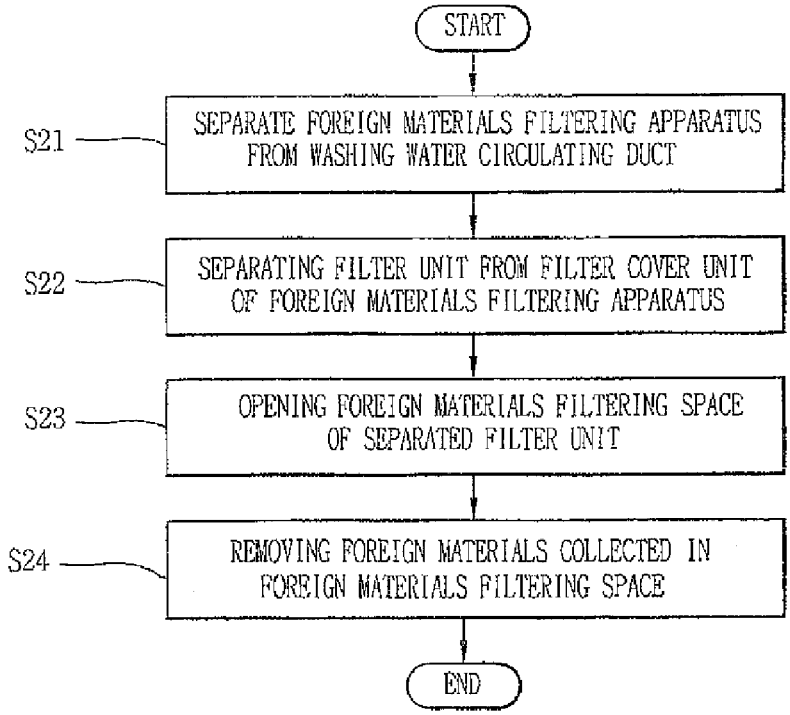
FIG. 14 is a flowchart showing a method for cleaning the foreign materials filtering apparatus of FIG. 1 under a state that a filter unit is separated from a filter cover unit.

FIG. 1 is a perspective views of a washing machine having a foreign materials filtering apparatus according to a first embodiment of the present invention; FIG. 2 is a side sectional view of the washing machine of FIG. 1; FIG. 3 is an exploded perspective view of the foreign materials filtering apparatus of FIG. 1; FIG. 4 is a perspective view showing a state that a foreign materials filtering apparatus is detachably mounted at a washing water circulating duct of FIG. 1; FIG. 5 is a sectional view taken along line 'V-V' of FIG. 4; FIG. 6 is an exploded rear view of the foreign materials filtering apparatus of FIG. 4; FIG. 7 is a view showing a state that a filter unit of FIG. 6 is separated from a filter cover unit; FIG. 8 is a view showing the filter cover unit of FIG. 7; FIG. 9 is a perspective view of a cap of FIG. 8; FIG. 10 is a view showing the filter unit of FIG. 7; FIG. 11 is a view showing a state that a rear filter of FIG. 10 is backward opened; FIG. 12 is a view showing a state that a rear filter of a filter unit of FIG. 6 is backward opened; FIG. 13 is a flowchart showing a method for cleaning the foreign materials filtering apparatus of FIG. 1 under a state that a filter unit is mounted at a filter cover unit; and FIG. 14 is a flowchart showing a method for cleaning the foreign materials filtering apparatus of FIG. 1 under a state that a filter is separated from a filter cover unit. Here, the dotted arrow indicates washing water flowing in a washing water circulating duct.

Referring to FIGS. 1 and 2, a washing machine 100 having a foreign materials filtering apparatus according to a first embodiment of the present invention comprises: a cabinet 110 that forms the appearance; a reservoir 120 received in the cabinet 110, for containing washing water therein; a washing tub 130 received in the reservoir 120, and consisting of an outer wall 132 and an inner wall 131; a pulsator 160 rotatably installed on a bottom surface of the inner wall 131, for stirring laundry; a driving unit 170 for simultaneously or individually driving the washing tub 130 and the pulsator 160; a washing water circulating duct 180 that forms a flow passage through which washing water rises toward an upper side of the washing tub 130 as the pulsator 160 rotates; and a foreign materials filtering apparatus 200 detachably mounted on the washing water circulating duct 180.

A top cover 111 is mounted at an upper portion of the cabinet 110. A lid 112 for opening and closing the washing tub 130 is installed at an upper portion of the top cover 111. A control panel 113 for controlling an operation of the washing machine 100 is installed at one side of the top cover 111, and a detergent box 115 is insertion-installed at an inner side of the top cover 111.

The washing tub 130 is composed of an outer wall 132 that forms the appearance, and an inner wall 131 spacing from the outer wall 132 with a certain gap and having a receiving space to receive laundry therein.

A plurality of drain holes 132*a* and 131*a* are penetratingly formed at the outer wall 132 and the inner wall 131, through which washing water inside the reservoir 120 flows in/out of the washing tub 130.

Referring to FIGS. 2 and 3, the washing water circulating duct 180 is formed between the outer wall 132 and the inner wall 131, and circulates washing water by guiding washing water collected below the pulsator 160 to an upper side of the washing tub 130 and then by flowing to the washing tub 130. A filter insertion hole 182 for mounting the foreign materials filtering apparatus 200 is formed at a middle portion of the washing water circulating duct 180. A guide protrusion 183 for covering a cap 220 of the foreign materials filtering apparatus 200 is protrudingly formed at the periphery of the filter insertion hole 182. Owing to the guide protrusion 183, the foreign materials filtering apparatus 200 can be stably mounted at a precise position of the washing water circulating duct 180.

Referring to FIGS. 4 and 5, the foreign materials filtering apparatus 200 is detachably mounted at the washing water circulating duct 180.

Referring to FIGS. 6 and 7, the foreign materials filtering apparatus 200 includes a filter cover unit 210, and a filter unit 250 detachably mounted at the filter cover unit 210.

Referring to FIGS. 8 and 9, the filter cover unit 210 includes a cap 220, and a handle 230 inserted into the cap 220. The cap 220 and the handle 230 may be integrally formed with each other. However, the handle 230 individually formed from the cap 220 may be inserted into the cap 220.

The cap 220 is a round-shaped lid, and is provided with a plurality of drain holes 221 radially arranged at a front lower end thereof. Through the drain holes 221, washing water having foreign materials removed therefrom is discharged to the washing tub 130.

The handle 230 has a ring shape of which central part inserted into the cap 220 is hollow. Hooks 231 to be coupled to hook coupling holes 181 of the washing water circulating duct 180 are formed at upper and lower portions of the handle 230. As a user separates the hooks 231 of the handle 230 from the hook coupling holes 181 with pressing the hooks 231 at both sides, the foreign materials filtering apparatus 200 is separated from the washing water circulating duct 180. The hooks 231 of the handle 230 are detachably mounted at the hook coupling holes 181 of the washing water circulating duct 180, thereby facilitating a detachable mounting of the handle 230 to the washing water circulating duct 180.

Under the structure, the foreign materials filtering apparatus 200 can be easily detached from the washing water circulating duct 180, thereby easily cleaning foreign materials collected into a foreign materials filtering space (S).

Referring to FIGS. 10 and 11, the filter unit 250 includes a front filter 260 installed at a rear side of the cap 220, and a rear filter 270 installed at a rear side of the front filter 260. As the front filter 260 and the rear filter 270 are coupled to each other, a foreign materials filtering space (S) is formed.

The front filter 260 includes a frame 261, and a coupling portion 263 detachably coupled to the handle 230 of the frame 261 and the rear filter 270.

A mesh 262 is formed at a front surface of the frame 261, thereby filtering foreign materials included in washing water. The mesh 262 may be directly formed on the front surface of the frame 261 in an injection manner. As shown in the preferred embodiment, the mesh 262 may be formed by forming mesh mounting holes 261*a* on the front surface of the frame 261 and then by inserting a wire mesh into the mesh mounting holes 261*a*.

The coupling portion 263 consists of coupling protrusions 263*a* formed at each middle part of both side surfaces of the frame 261, coupling holes 263*b* formed at each upper end of both side surfaces of the frame 261, and hinge holes 263*c* formed at each lower end of both side surfaces of the frame 261.

The coupling protrusions 263*a* are inserted into coupling holes 233 (refer to FIG. 9) of the handle 230. Preferably, the coupling protrusions 263*a* are protruding with a height high enough to be easily detachably mounted to the coupling holes 233. It is also possible that the coupling protrusions 263*a* are formed at the handle 230, and the coupling holes 233 are formed at the frame 261.

Coupling protrusions 273*a* of the rear filter 270 are inserted into the coupling holes 263*b*, and hinges 273*b* of the rear filter 270 are inserted into the hinge holes 263*c*.

As the coupling protrusions 263*a* are detachably mounted at the coupling holes 233, the front filter 260 can be easily detachably mounted at the handle 230. Accordingly, the filter unit 250 is easily separated from the filter cover unit 210, and the foreign materials filtering space (S) of the filter unit 250 filled with foreign materials can be easily cleaned.

The rear filter 270 includes a frame 271, and a coupling portion 273 formed at the frame 271 and for coupling the rear filter 270 to the front filter 260.

The coupling portion 273 consists of coupling protrusions 273*a* formed at both side surfaces of the frame 271, and hinges 273*b* for rotating the frame 271 with respect to the front filter 260.

The coupling protrusions 273*a* are inserted into the coupling holes 263*b* of the front filter 260. Preferably, the coupling protrusions 273*a* are protruding with a height high enough to be easily detachably mounted to the coupling holes 263*b*. It is also possible that the coupling protrusions 273*a* are formed at the front filter 260, and the coupling holes 263*b* are formed at the rear filter 270. Owing to the detachable mounting structure between the coupling protrusions 273*a* and the coupling holes 263*b*, the rear filter 270 can be easily detachably mounted at the front filter 260.

The hinges 273*b* are inserted into the hinge holes 263*c* of the front filter 260. It is also possible that the hinges 273*b* are formed at the front filter 260, and the hinge holes 263*c* are formed at the rear filter 270. If the rear filter 270 is rotated centering around the hinges 273*b* with respect to the front filter 260, the foreign materials filtering space (S) is easily opened owing to the detachable mounting structure between the coupling protrusion 273*a* of the rear filter 270 and the coupling hole 263*b* of the front filter 260. Accordingly, foreign materials collected in the foreign materials filtering space (S) can be easily removed. As a result, can be solved the conventional problems that a net filter has to be kept inside out at the time of a cleaning process to cause a user's hands to become dirty, and there is a difficulty in removing foreign materials from the net filter due to a fibrous characteristic of the net filter.

Hereinafter, a method for cleaning a foreign materials filtering apparatus according to a first embodiment of the present invention will be explained in more detail.

Referring to FIGS. 5, 12 and 13, there is a method for cleaning the foreign materials filtering apparatus 200 under a state that the filter unit 250 is mounted at the filter cover unit 210.

First, the foreign materials filtering apparatus 200 is separated from the washing water circulating duct 180 under a state that the hooks 231 of the handle 230 are pressed in two directions indicated by the arrows (S11).

Then, the rear filter 270 is backward pulled so as to rotate centering around the hinges 273*b* in a direction of the arrow. Here, the coupling protrusions 273*a* of the rear filter 270 rotate centering around the hinge holes 263*c* while being separated from the coupling holes 263*b* of the front filter 260, thereby backward opening the foreign materials filtering space (S) (S12).

Then, a user removes foreign materials collected in the foreign materials filtering space (S) (S13).

Referring to FIGS. 5, 7, 11 and 14, there is a method for cleaning the foreign materials filtering apparatus 200 under a state that the filter unit 250 is separated from the filter cover unit 210.

First, the foreign materials filtering apparatus 200 is separated from the washing water circulating duct 180 under a state that the hooks 231 of the handle 230 are pressed in two directions indicated by the arrows (S21).

Then, the front filter 260 is pulled in a direction of the arrow so that the coupling protrusions 263*a* thereof can be separated from the coupling holes 233 of the handle 230, thereby separating the front and rear filters 260 and 270 from the handle 230 (S22).

Then, the rear filter 270 is backward pulled so as to rotate centering around the hinges 273*b* in a direction of the arrow. Accordingly, the coupling protrusions 273*a* of the rear filter 270 are separated from the coupling holes 263*b* of the front filter 260, and thus the rear filter 270 is backward opened (S23).

Then, a user removes foreign materials collected in the foreign materials filtering space (S) (S24).

As aforementioned, in the method for cleaning the foreign materials filtering apparatus according to the present invention, foreign materials collected in the foreign materials filtering space (S) can be easily removed in various manners under the filter unit is separated or is mounted at the filter cover unit. As a result, can be solved the conventional problems that a net filter has to be kept inside out at the time of a cleaning process to cause a user's hands to become dirty, and there is a difficulty in removing foreign materials from the net filter due to a fibrous characteristic of the net filter. Accordingly, a cleaning operation for the foreign materials filtering apparatus can be facilitated The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A foreign materials filtering apparatus detachably installed at a washing water circulation duct which circulates washing water, the apparatus comprising:

a handle coupled to the washing water circulation duct, and having a round ring shape;

a front filter mounted to an inner circumferential surface of the handle, and having a mesh;

a rear filter hinge-coupled to the front filter at a lower side, and forming a foreign materials collecting space; and a cap configured to an outer circumferential surface of the handle.

2. The apparatus of claim 1, wherein hooks detachably coupled to hook coupling holes of the washing water circulating duct are formed at the handle.

3. The apparatus of claim 2, wherein coupling protrusions are formed on side surfaces of the front filter, and coupling holes for inserting the coupling protrusions are formed at the handle.

4. The apparatus of claim 1, wherein coupling protrusions are formed on side surfaces of the rear filter, and coupling holes for inserting the coupling protrusions of the rear filter are formed on side surfaces of the front filter.

5. A washing machine, comprising:

a reservoir disposed in a cabinet, and containing washing water therein;

a washing tube disposed in the reservoir, and accommodating laundry therein;

a pulsator disposed at a bottom of the washing tub, and configured to stir the washing water;

a washing water circulation duct disposed between an inner wall and an outer wall of the washing tub; and a foreign materials filtering apparatus detachably mounted to the washing water circulation duct, and configured to filter foreign materials from circulating washing water, wherein the foreign materials filtering apparatus comprises:

a handle coupled to the washing water circulation duct, and having a round ring shape;

a front filter mounted to an inner circumferential surface of the handle, and having a mesh;

a rear filter hinge-coupled to the front filter at a lower side, and forming a foreign materials collecting space; and a cap configured to an outer circumferential surface of the handle.

6. The washing machine of claim 5, wherein hooks detachably coupled to hook coupling holes of the circulating duct are formed at the handle.

7. The washing machine of claim 6, wherein coupling protrusions are formed on side surfaces of the front filter, and coupling holes for inserting the coupling protrusions are formed at the handle.

8. The washing machine of claim 5, wherein coupling protrusions are formed on side surfaces of the rear filter, and coupling holes for inserting the coupling protrusions of the rear filter are formed on side surfaces of the front filter.

* * * * *